US009902165B2

(12) United States Patent
Kawashima et al.

(10) Patent No.: US 9,902,165 B2
(45) Date of Patent: Feb. 27, 2018

(54) INK SUPPLY SYSTEM AND INKJET PRINTER

(71) Applicant: Roland DG Corporation, Hamamatsu-shi, Shizuoka (JP)

(72) Inventors: Tadashi Kawashima, Hamamatsu (JP); Yasuhiko Kobayashi, Hamamatsu (JP); Takefumi Endo, Hamamatsu (JP); Yusuke Takano, Hamamatsu (JP); Teppei Sawada, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/460,543

(22) Filed: Mar. 16, 2017

(65) Prior Publication Data

US 2017/0274668 A1 Sep. 28, 2017

(30) Foreign Application Priority Data

Mar. 22, 2016 (JP) ..... 2016-056564

(51) Int. Cl.
*B41J 2/175* (2006.01)

(52) U.S. Cl.
CPC ..... *B41J 2/17596* (2013.01); *B41J 2/175* (2013.01); *B41J 2/17566* (2013.01)

(58) Field of Classification Search
CPC ..... B41J 2/175; B41J 2/17566; B41J 2/17596
See application file for complete search history.

(56) References Cited

U.S. PATENT DOCUMENTS

2004/0257410 A1* 12/2004 Yamada ..... B41J 2/175 347/84
2014/0015905 A1* 1/2014 Esdaile-Watts ..... B41J 2/18 347/89
2015/0035901 A1* 2/2015 Obata ..... B41J 2/175 347/36
2016/0031226 A1* 2/2016 Nishiyama ..... B41J 2/17596 347/85
2016/0288554 A1* 10/2016 Nakamura ..... B41J 2/2146

FOREIGN PATENT DOCUMENTS

JP 2010-094847 A 4/2010

* cited by examiner

*Primary Examiner* — Julian Huffman
(74) *Attorney, Agent, or Firm* — Keating & Bennett, LLP

(57) ABSTRACT

In an ink supply system, a main ink tank and an ink head are connected together via a main supply channel. A sub-ink tank is connected to the main supply channel via a sub-supply channel. An upstream-side valve is provided on an upstream-side portion of the main supply channel. During standby, a first standby setting processor of a controller sets a first standby state in which a first upstream-side valve is open, and a second standby setting processor sets a second standby state in which the first upstream-side valve is closed. A standby state determination processor determines whether or not the amount of time elapsed from when a setting operation was done by the first standby setting processor or the second standby setting processor is greater than or equal to a first amount of time. The standby state switching processor switches between the first standby state and the second standby state when it is determined that the elapsed time is greater than or equal to the first amount of time.

11 Claims, 10 Drawing Sheets

INK SUPPLY SYSTEM AND INKJET PRINTER

CROSS REFERENCE TO RELATED APPLICATIONS

This application claims the benefit of priority to Japanese Patent Application No. 2016-056564 filed on Mar. 22, 2016. The entire contents of this application are hereby incorporated herein by reference.

BACKGROUND OF THE INVENTION

1. Field of the Invention

The present invention relates to an ink supply system and an inkjet printer.

2. Description of the Related Art

There are conventional inkjet printers using additional ink tanks, in addition to ink cartridges that supply ink to ink heads for discharging ink, in order to increase the amount of ink available (see, for example, Japanese Laid-Open Patent Publication No. 2010-94847).

With inkjet printers of this type, an ink head and an ink cartridge are connected together via a main supply channel. Another ink tank is connected to a middle portion of the main supply channel via a sub-supply channel. A solenoid valve is provided at a downstream portion of the main supply channel. When printing, the solenoid valve is opened so that ink stored in the ink cartridge and/or the other ink tank is supplied to the ink head. During standby, the solenoid valve is closed so that ink stored in the ink cartridge and the other ink tank is not supplied to the ink head.

With the inkjet printer described above, however, the solenoid valve is closed during standby. Therefore, when the temperature around the inkjet printer increases, ink in a section of the main supply channel between the solenoid valve and the ink head may possibly swell. During standby, ink in a section of the main supply channel between the solenoid valve and the ink head may possibly swell, resulting in ink leakage from the ink head.

SUMMARY OF THE INVENTION

Preferred embodiments of the present invention, which has been developed in view of the problem set forth above, provide an ink supply system and an inkjet printer, with which it is possible to prevent ink from swelling and leaking from the ink head during standby.

An ink supply system according to a preferred embodiment of the present invention includes a first ink head, a first main ink tank, a first sub-ink tank, a first main supply channel, a first sub-supply channel, a first upstream-side valve and a controller.

The first ink head includes a first nozzle that discharges ink. The first main ink tank and the first sub-ink tank store ink. The first main supply channel includes a first main upstream portion connected to the first main ink tank, a first main downstream portion connected to the first ink head, and a first middle portion located between the first main upstream portion and the first main downstream portion. The first sub-supply channel includes a first sub-upstream portion connected to the first sub-ink tank, and a first sub-downstream portion connected to the first middle portion of the first main supply channel. The upstream-side valve is provided on the first main upstream portion of the first main supply channel, the upstream-side valve being able to be opened and closed. The controller controls an open/closed state of the first upstream-side valve. The controller includes a first standby setting processor, a second standby setting processor, a standby state determination processor and a standby state switching processor. The first standby setting processor sets a first standby state in which the first upstream-side valve is open during standby. The second standby setting processor sets a second standby state in which the first upstream-side valve is closed during standby. The standby state determination processor determines whether or not an amount of time elapsed from when a setting operation was done by the first standby setting processor or the second standby setting processor is greater than or equal to a first amount of time. The standby state switching processor either switches from the first standby state to the second standby state or switches from the second standby state to the first standby state when it is determined by the standby state determination processor that the elapsed time is greater than or equal to the first amount of time.

With the ink supply system, the open/closed state of the valves is switched from the first standby state to the second standby state or from the second standby state to the first standby state, during standby, after every passage of an amount of time that is greater than or equal to the first amount of time. Therefore, for example, during standby, since the first upstream-side valve is open in the first standby state, the pressure in the main supply channel is released toward the first ink cartridge. Therefore, during standby, it is possible to prevent ink from swelling and leaking from the ink head.

Another ink supply system according to a preferred embodiment of the present invention includes a first ink head, a first main ink tank, a first sub-ink tank, a first main supply channel, a first sub-supply channel, a first downstream-side valve and a controller. The first ink head discharges ink. The first main ink tank and the first sub-ink tank store ink. The first main supply channel includes a first main upstream portion connected to the first main ink tank, a first main downstream portion connected to the first ink head, and a first middle portion located between the first main upstream portion and the first main downstream portion. The first sub-supply channel includes a first sub-upstream portion connected to the first sub-ink tank, and a first sub-downstream portion connected to the first middle portion of the first main supply channel. The first downstream-side valve is provided between the first middle portion and the first main downstream portion of the first main supply channel, the first downstream-side valve being able to open and close the first main downstream portion. The controller controls an open/closed state of the first downstream-side valve. The controller includes a first standby setting processor, a second standby setting processor, a standby state determination processor and a standby state switching processor. The first standby setting processor sets a first standby state in which the first downstream-side valve is open. The second standby setting processor sets a second standby state in which the first downstream-side valve is closed. The standby state determination processor determines whether or not an amount of time elapsed from when a setting operation was done by the first standby setting processor or the second standby setting processor is greater than or equal to a first amount of time. The standby state switching processor either switches from the first standby state to the second standby state or switches from the second standby state to the first standby state when it is determined by the standby state determination processor that the elapsed time is greater than or equal to the first amount of time, during standby.

With the ink supply system, the open/closed state of the valves is switched from the first standby state to the second standby state or from the second standby state to the first standby state, during standby, after every passage of an amount of time that is greater than or equal to the first amount of time. Therefore, for example, during standby, since the first downstream-side valve is open in the first standby state, the pressure in the main supply channel is released toward the first ink cartridge. Therefore, during standby, it is possible to prevent ink from leaking from the ink head.

According to various preferred embodiments of the present invention, it is possible to prevent ink from swelling and leaking from an ink head during standby.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Ink supply systems according to preferred embodiments of the present invention and inkjet printers including the same (hereinafter referred to simply as a "printer") will now be described with reference to the drawings. Note that the preferred embodiments to be described hereinbelow are not intended to limit the scope of the present invention. Elements or features with the same or similar function will be denoted by the same reference signs, and redundant descriptions will be omitted or simplified.

First Preferred Embodiment

Figure 1:
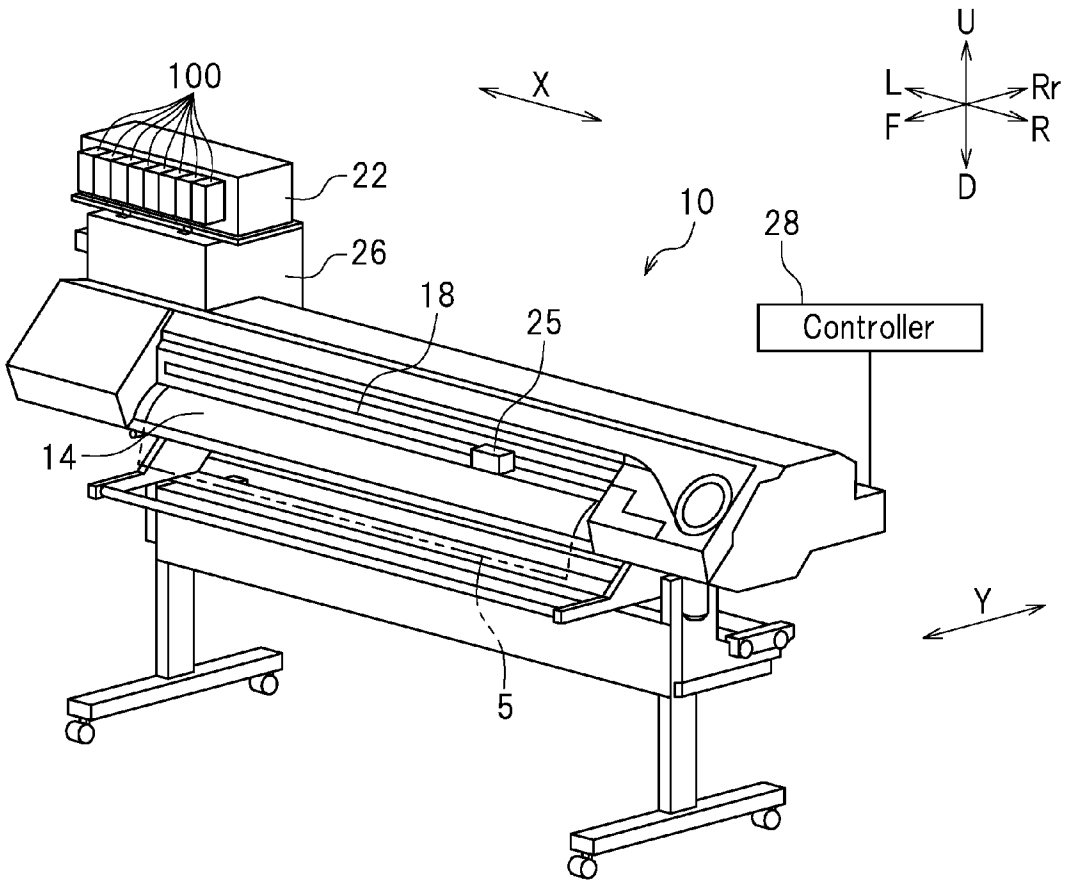
FIG. 1 is a perspective view of a printer according to a first preferred embodiment of the present invention.

FIG. 1 is a perspective view of a printer 10 according to a first preferred embodiment of the present invention. In FIG. 1, when the printer 10 is seen from the front side, the direction away from the printer 10 will be referred to as "front", and the direction toward the printer 10 as "rear". The terms "left", "right", "up" and "down" refer to these directions when the printer 10 is seen from the front side. The designations F, Rr, L, R, U and D, as used in the figures, refer to front, rear, left, right, up and down, respectively. Note however that these designations of direction are used merely for the purpose of illustration, and do not in any way limit how the printer 10 is installed and do not in any way limit the present invention. The character "X" in the figures denotes the main scanning direction. Herein, the main scanning direction X is the left-right direction, for example. The character "Y" in the figures denotes the sub scanning direction. Herein, the sub scanning direction Y is the front-rear direction, for example. The main scanning direction X and the sub scanning direction Y are perpendicular to each other as seen from above. Note however that there is no particular limitation on the main scanning direction X and the sub scanning direction Y, and these directions may be set appropriately in accordance with each preferred embodiment of the printer 10.

The printer 10 of the present preferred embodiment preferably is an inkjet printer. The term "inkjet" as used in the present preferred embodiment refers to inkjet printing of any of various methods known in the art, e.g., continuous printing such as binary deflection printing or continuous deflection printing, and on-demand printing such as thermal printing or piezoelectric printing, for example. The printer 10 prints on a recording medium 5.

The recording medium 5 is recording paper, for example. Note however that the recording medium 5 is not limited to recording paper. For example, the recording medium 5 may be a sheet recording medium, e.g., a sheet made of a resin such as PVC or polyester. The recording medium 5 may include aluminum, iron, wood, leather, etc. There is no particular limitation on the flexibility and the thickness of the recording medium 5. That is, the recording medium 5 may be a hard medium such as a glass substrate. The recording medium 5 may also be a thick medium such as a cardboard.

Figure 2:
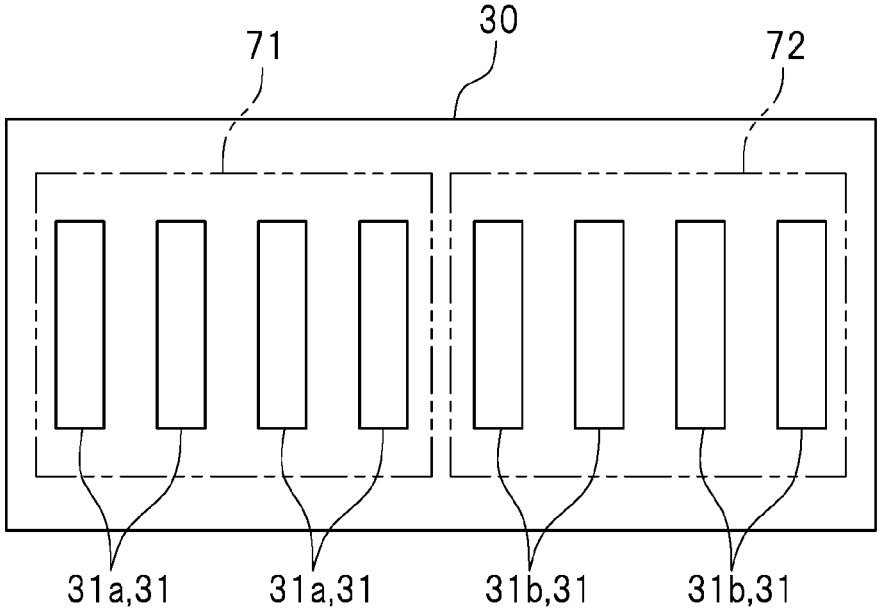
FIG. 2 is a conceptual diagram showing an ink supply system.

In the present preferred embodiment, the printer 10 includes a platen 14, a guide rail 18 and an ink supply system 30 (see FIG. 2). The recording medium 5 is placed on the platen 14. Although not shown in the figures, a cylindrical grit roller is provided on the platen 14. The grit roller is buried in the platen 14 with the upper surface thereof exposed.

The guide rail 18 is located above the platen 14. The guide rail 18 is parallel or substantially parallel to the platen 14. The platen 14 extends in the main scanning direction X. Although not shown in the figures, a plurality of pinch rollers are arranged generally at equal or substantially equal intervals below the guide rail 18. These pinch rollers oppose the grit roller. The pinch rollers are structured so that the positions thereof in the up-down direction are able to be set depending on the thickness of the recording medium 5. The recording medium 5 is sandwiched between the grit roller and the pinch rollers. The grit roller and the pinch rollers carry the recording medium 5, sandwiched therebetween, in the sub scanning direction Y.

Figure 3:
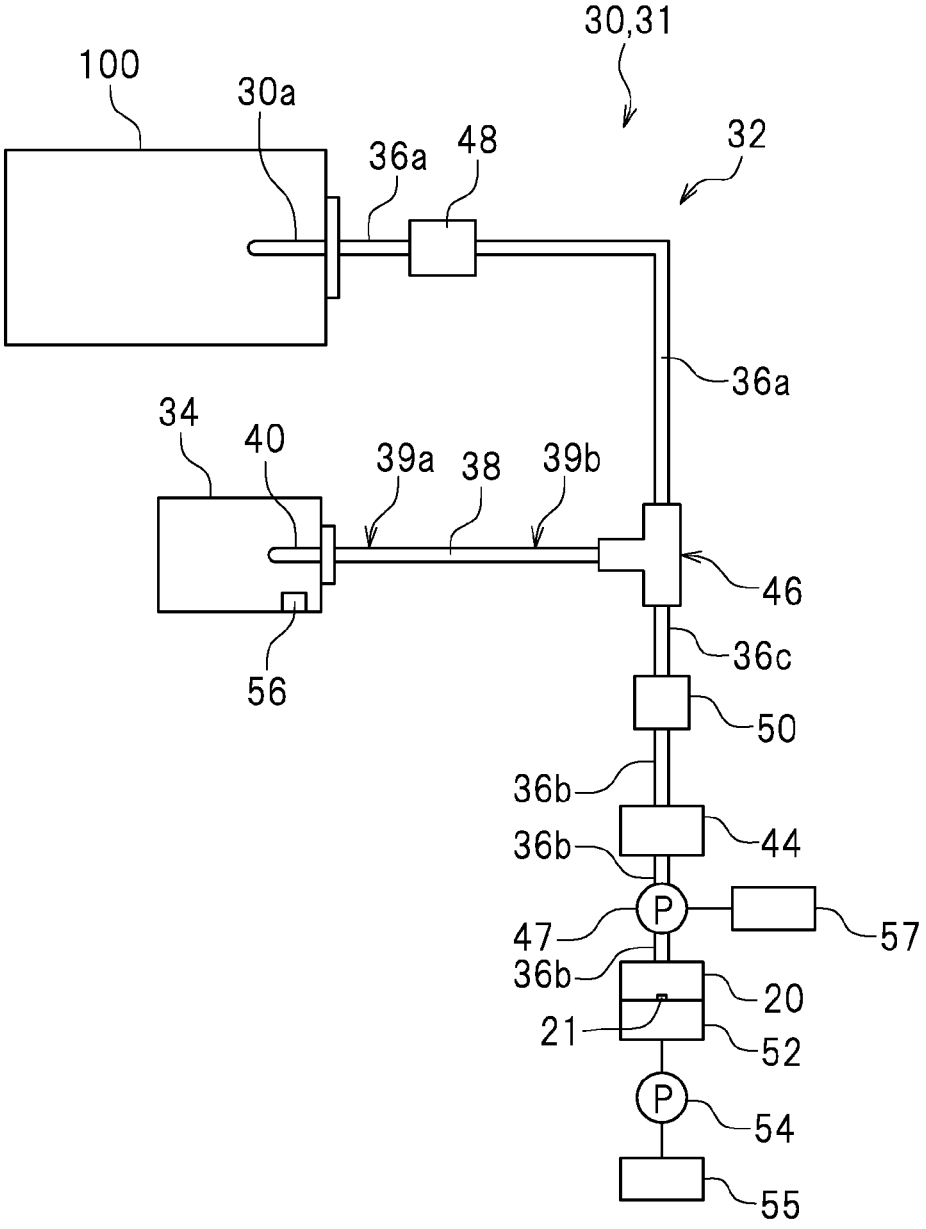
FIG. 3 is a schematic diagram showing the ink supply system.

Next, the ink supply system 30 will be described. FIG. 2 is a conceptual diagram showing the ink supply system 30. FIG. 3 is a schematic diagram showing the ink supply system 30. In the present preferred embodiment, as shown in FIG. 2, the ink supply system 30 includes a plurality of ink supply mechanisms 31 and a controller 28 (see FIG. 1). As shown in FIG. 3, the ink supply mechanism 31 supplies ink from an ink cartridge 100 and/or a sub-tank 34 to be described below to an ink head 20. The ink supply system 30 preferably includes the same number of ink supply mechanisms 31 as the number of ink heads 20, for example. In the present preferred embodiment, preferably the number of ink heads 20 is "8", and the number of ink supply mechanisms 31 is "8", for example. Note however that there is no particular limitation on the number of ink heads 20 and the number of ink supply mechanisms 31. Note that the ink supply mechanisms 31 have the same structure.

The ink supply mechanism 31 of the ink supply system 30 includes the ink head 20, the ink cartridge 100, the sub-tank 34, a main supply channel 32, an upstream-side valve 48, a sub-supply channel 38 and the downstream-side valve 50.

The ink head 20 discharges ink onto the recording medium 5 (see FIG. 1) placed on the platen 14 (see FIG. 1). The ink head 20 includes a nozzle 21 that discharges ink. Although not shown in the figures, the ink head 20 is mounted on a carriage 25 (see FIG. 1). The carriage 25 is in engagement with the guide rail 18. The carriage 25 is slidable on the guide rail 18. The carriage 25 is movable in the main scanning direction X. The ink heads 20 are movable in the main scanning direction X along the guide rail 18 via the carriage 25. Although not shown in the figures, a portion of a drive belt extending in the left-right direction is secured on an upper portion on the back of the carriage 25. The drive belt is electrically connected to a scan motor. As the scan motor is driven, the ink heads 20 move in the main scanning direction X.

The ink cartridge 100 stores ink. In the present preferred embodiment, the number of ink cartridges 100 preferably is the same as the number of ink heads 20, for example. One ink head 20 is connected to one ink cartridge 100. There is no particular limitation on the type of an ink to be stored in each of the ink cartridges 100. For example, an ink to be stored in each of the ink cartridges 100 may be any of a process color ink such as a cyan ink, a magenta ink, a yellow ink, a black ink, a light cyan ink, a light magenta ink and a light black ink, or a special color ink such as a white ink, a metallic ink and a clear ink. In the present preferred embodiment, a magenta ink is preferably stored, as a "dummy ink", in one of the ink cartridges 100, for example. Inks of different colors are stored in the other ink cartridges 100. Note that the ink to be used as the dummy ink is not limited to a magenta ink. The ink head 20 connected to the ink cartridge 100 storing a magenta ink as a dummy ink therein is not used when printing. Note however that all of the ink heads 20 may be used when printing. In such a case, the ink cartridges 100 store inks of different colors, each storing any of the process color inks and the special color inks.

In the present preferred embodiment, the amount of ink that is able to be stored in one ink cartridge 100 is referred to as the "first amount". There is no particular limitation on where the ink cartridges 100 are arranged. In the present preferred embodiment, as shown in FIG. 1, an ink cartridge accommodating section 22 is provided on an upper-left portion of the printer 10. The ink cartridges 100 are accommodated in the ink cartridge accommodating section 22. Herein, the ink cartridges 100 are secured on the main body of the printer 10. Note however that the ink cartridges 100 may be secured on the ink heads 20. Alternatively, the ink cartridges 100 may be provided at a position away from the printer 10. As shown in FIG. 3, ink stored the ink cartridge 100 is supplied to the sub-tank 34 and the ink head 20.

The sub-tank 34 stores ink. In the present preferred embodiment, the amount of ink that is able to be stored in the sub-tank 34 is referred to as the "second amount". The second amount is smaller than the first amount representing the amount of ink that can be stored in the ink cartridge 100. That is, the sub-tank 34 is capable of storing an amount of ink that is smaller than that of the ink cartridge 100. In the present preferred embodiment, the first amount preferably is about 5 to about 20 times larger than the second amount. For example, the first amount preferably is about 1000 ml. The second amount preferably is about 100 ml. However, as long as the first amount is larger than the second amount, there is no particular limitation on the ratio between the first amount and the second amount, the specific value of the first amount and the specific value of the second amount.

Note that there is no particular limitation on where the sub-tanks 34 are arranged. In the present preferred embodiment, as shown in FIG. 1, a sub-tank accommodating section 26 is provided on an upper-left portion of the printer 10 and below the ink cartridge accommodating section 22. Although not shown in the figures, the sub-tanks 34 are accommodated in the sub-tank accommodating section 26. Herein, the sub-tanks 34 are secured on the main body of the printer 10, as are the ink cartridges 100. Note however that the sub-tanks 34 may be secured on the ink heads 20. Alternatively, the sub-tanks 34 may be provided at a position spaced away from the printer 10. Herein, the sub-tanks 34 are arranged at a position below the ink cartridges 100.

Note that as shown in FIG. 3, the sub-tank 34 may be provided with a detection sensor 56 to detect the amount of ink stored in the sub-tank 34. The detection sensor 56 detects the amount of ink stored in the sub-tank 34 being less than or equal to a predetermined amount that is smaller than the second amount. The predetermined amount is pre-stored in a storage processor 61 (see FIG. 4) of the controller 28 to be described below. Note that there is no particular limitation on the type of the detection sensor 56. For example, the detection sensor 56 may include a photosensor.

Note that ink stored in the ink cartridge 100 and the sub-tank 34 is preferably deaerated.

As shown in FIG. 3, the main supply channel 32 is a channel used to supply ink stored in the ink cartridge 100 and ink stored in the sub-tank 34 to the ink head 20. The main supply channel 32 is a flexible tube, for example. However, there is no particular limitation on the material of the main supply channel 32.

In the description below, one side that is closer to the ink cartridge 100, between the ink cartridge 100 and the ink head 20, will be referred to as the upstream side. The other side that is closer to the ink head 20 will be referred to as the downstream side. The main supply channel 32 includes a main upstream portion **36*a*, a main downstream portion 36*b* and a middle portion 36*c*. The main upstream portion 36*a* is an upstream portion of the main supply channel 32. The main upstream portion 36*a* is removably connected to the ink cartridge 100. In the present preferred embodiment, an ink extraction member 30*a* is provided at the upstream end of the main upstream portion 36*a*. The ink extraction member 30*a* is removably inserted into the ink cartridge 100. Thus, it is possible to prevent ink leakage from the connection between the main upstream portion 36*a* and the ink cartridge 100. Note that the main upstream portion 36*a* may be un-removably connected to the ink cartridge 100**.

The main downstream portion **36*b* is a downstream portion of the main supply channel 32. The main downstream portion 36*b* is connected to the ink head 20. The middle portion 36*c* is a middle portion of the main supply channel 32. Herein, the middle portion 36*c* is located between the main upstream portion 36*a* and the main downstream portion 36*b*. Specifically, a three-way valve 46 is provided at the upstream end of the middle portion 36*c***.

The downstream end of the main upstream portion 36*a* is connected to the upstream end of the middle portion 36*c* via the three-way valve 46. The downstream-side valve 50 is connected to the downstream end of the middle portion 36*c*. The upstream end of the main downstream portion 36*b* is connected to the downstream end of the middle portion 36*c* via the downstream-side valve 50.

The upstream-side valve 48 opens and closes the main supply channel 32. The upstream-side valve 48 adjusts the amount of ink flowing from the ink cartridge 100 to the ink head 20. The upstream-side valve 48 is provided on the main supply channel 32. Specifically, the upstream-side valve 48 is provided on the main upstream portion 36*a* of the main supply channel 32. There is no particular limitation on the type of the upstream-side valve 48. For example, the upstream-side valve 48 is a solenoid valve. The upstream-side valve 48 is controlled by a driving signal sent from the controller 28 (see FIG. 1).

The sub-supply channel 38 is a channel used to supply ink stored in the sub-tank 34 to the ink head 20 via the main supply channel 32. The sub-supply channel 38 is a channel used to supply ink stored in the ink cartridge 100 to the sub-tank 34. Herein, the sub-supply channel 38 is a flexible tube, as is the main supply channel 32. However, there is no particular limitation on the material of the sub-supply channel 38.

In the present preferred embodiment, the sub-supply channel 38 includes a sub-upstream portion 39*a* and a sub-downstream portion 39*b*. The sub-upstream portion 39*a* is an upstream portion of the sub-supply channel 38. The sub-tank 34 is removably connected to the sub-upstream portion 39*a*. In the present preferred embodiment, an ink extraction member 40 is provided at the upstream end of the sub-upstream portion 39*a*. The ink extraction member 40 is removably inserted into the sub-tank 34. Note that the sub-upstream portion 39*a* may be un-removably connected to the sub-tank 34. The sub-downstream portion 39*b* is a downstream portion of the sub-supply channel 38. The sub-downstream portion 39*b* is connected to the main upstream portion 36*a* and the middle portion 36*c* of the main supply channel 32. Specifically, the upstream end of the sub-downstream portion 39*b* is connected to the downstream end of the sub-upstream portion 39*a*. The three-way valve 46, to which the downstream end of the main upstream portion 36*a* and the upstream end of the middle portion 36*c* are connected, is connected to the downstream end of the sub-downstream portion 39*b*.

The downstream-side valve 50 opens and closes the main downstream portion 36*b* of the main supply channel 32. The downstream-side valve 50 adjusts the amount of ink flowing from the ink cartridge 100 to the ink head 20 and the amount of ink flowing from the sub-tank 34 to the ink head 20. The downstream-side valve 50 is connected between the middle portion 36*c* and the main downstream portion 36*b* of the main supply channel 32. There is no particular limitation on the type of the downstream-side valve 50. For example, the downstream-side valve 50 is a solenoid valve, as is the upstream-side valve 48. The downstream-side valve 50 is controlled by a driving signal sent from the controller 28 (see FIG. 1).

Note that the ink supply mechanism 31 may include a damper and a supply pump 47. The damper 44 dampens ink pressure fluctuations to stabilize the ink discharge operation of the ink head 20. In the present preferred embodiment, the damper 44 is provided on a middle portion of the main downstream portion 36*b* of the main supply channel 32, on the downstream side of the downstream-side valve 50. The damper 44 is located between the downstream-side valve 50 and the ink head 20.

The supply pump 47 supplies ink stored in the ink cartridge 100 and ink stored in the sub-tank 34 to the ink head 20, and to pump the ink to be discharged from the ink head 20. A drive motor 57 is electrically connected to the supply pump 47. As the drive motor 57 is driven to actuate the supply pump 47, ink stored in the ink cartridge 100 and ink stored in the sub-tank 34 are supplied to the ink head 20. In the present preferred embodiment, the supply pump 47 is provided on a middle portion of the main downstream portion 36*b* of the main supply channel 32, on the downstream side of the downstream-side valve 50 and the damper 44. The supply pump 47 is located between the damper 44 and the ink head 20.

In the present preferred embodiment, the ink supply mechanism 31 may include a cap 52 and a suction pump 54. Although not shown in the figures, the cap 52 and the suction pump 54 are located at the home position, which is located on the right end of the guide rail 18. The home position refers to the position where the ink head 20 stands by during standby. The cap 52 prevents ink on the nozzle 21 of the ink head 20 from hardening and clogging the nozzle 21. The cap 52 is attached to the ink head 20 so as to cover the nozzle 21 of the ink head 20 during standby, other than when printing. The suction pump 54 sucks ink and air in the cap 52. Herein, the suction pump 54 is connected to the cap 52. A drive motor 55 is electrically connected to the suction pump 54. With the cap 52 attached to the ink head 20, the drive motor 55 is driven to appropriately actuate the suction pump 54, thus sucking air in the cap 52, the ink head 20, the main supply channel 32 and the sub-supply channel 38.

Figure 4:
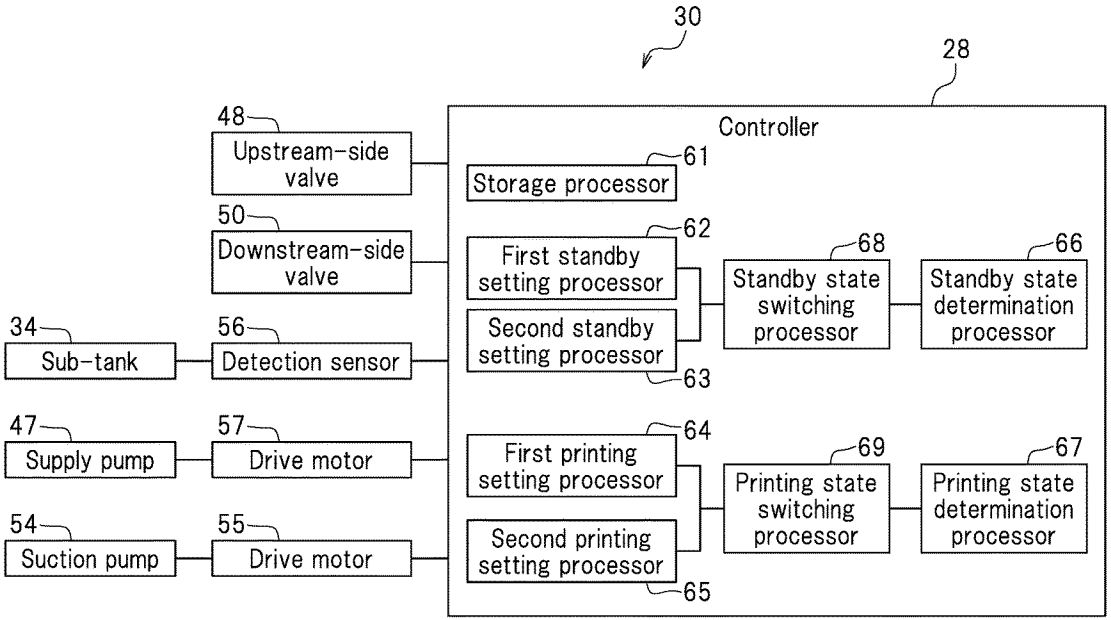
FIG. 4 is a block diagram of the ink supply system.

The ink supply mechanism 31 according to the present preferred embodiment has been described above. Next, the controller 28 will be described. FIG. 4 is a block diagram of the ink supply system 30. As shown in FIG. 4, the controller 28 is configured or programmed to control a printing operation and to control ink supply to the ink head 20. There is no particular limitation on the configuration of the controller 28. For example, the controller 28 may be a computer and may include a central processing unit (hereinafter referred to as a "CPU"), a ROM storing a program, or the like, to be executed by the CPU, and a RAM, etc.

The controller 28 controls the upstream-side valve 48, the downstream-side valve 50, the detection sensor 56 provided in the sub-tank 34, the drive motor 57 electrically connected to the supply pump 47, and the drive motor 55 electrically connected to the suction pump 54. The controller 28 controls opening and closing of the main upstream portion 36*a* of the main supply channel 32 by controlling the open/closed state of the upstream-side valve 48. The controller 28 controls the opening and closing of the main downstream portion 36*b* of the main supply channel 32 by controlling the open/closed state of the downstream-side valve 50. In the present preferred embodiment, the controller 28 controls the open/closed state of the upstream-side valve 48 and the downstream-side valve 50 of the ink supply mechanism 31 so as to control the timing to supply ink stored in the ink cartridge 100 to the ink head 20 and the sub-tank 34 and the timing to supply ink stored in the sub-tank 34 to the ink head 20.

The controller 28 detects the amount of ink stored in the sub-tank 34 by receiving a signal sent from the detection sensor 56. The controller 28 controls the actuation of the supply pump 47 by controlling the driving of the drive motor 57. The controller 28 controls the actuation of the suction pump 54 by controlling the driving of the drive motor 55.

In the present preferred embodiment, the controller 28 includes the storage processor 61, a first standby setting processor 62, a second standby setting processor 63, a first printing setting processor 64, a second printing setting processor 65, a standby state determination processor 66, a printing state determination processor 67, a standby state switching processor 68, and a printing state switching processor 69. Note that the storage processor 61, the first standby setting processor 62, the second standby setting processor 63, the first printing setting processor 64, the second printing setting processor 65, the standby state determination processor 66, the printing state determination processor 67, the standby state switching processor 68 and the printing state switching processor 69 maybe implemented as software or hardware, and may be one processor or a plurality of processors.

In the present preferred embodiment, as shown in FIG. 2, the controller 28 performs the same control on four of the eight ink supply mechanisms 31 and performs the same control on the other four ink supply mechanisms 31. Now, one group of four of the eight ink supply mechanisms 31 will be referred to as a first group 71, and the other group of four ink supply mechanisms 31 as a second group 72, for example. Note however that there is no particular limitation on the number of ink supply mechanisms 31 included in the first group 71, and the number of ink supply mechanisms 31 included in the second group 72. The number of ink supply mechanisms 31 included in the first group 71 may be the same as, or different from, the number of ink supply mechanisms 31 included in the second group 72.

Figure 5:
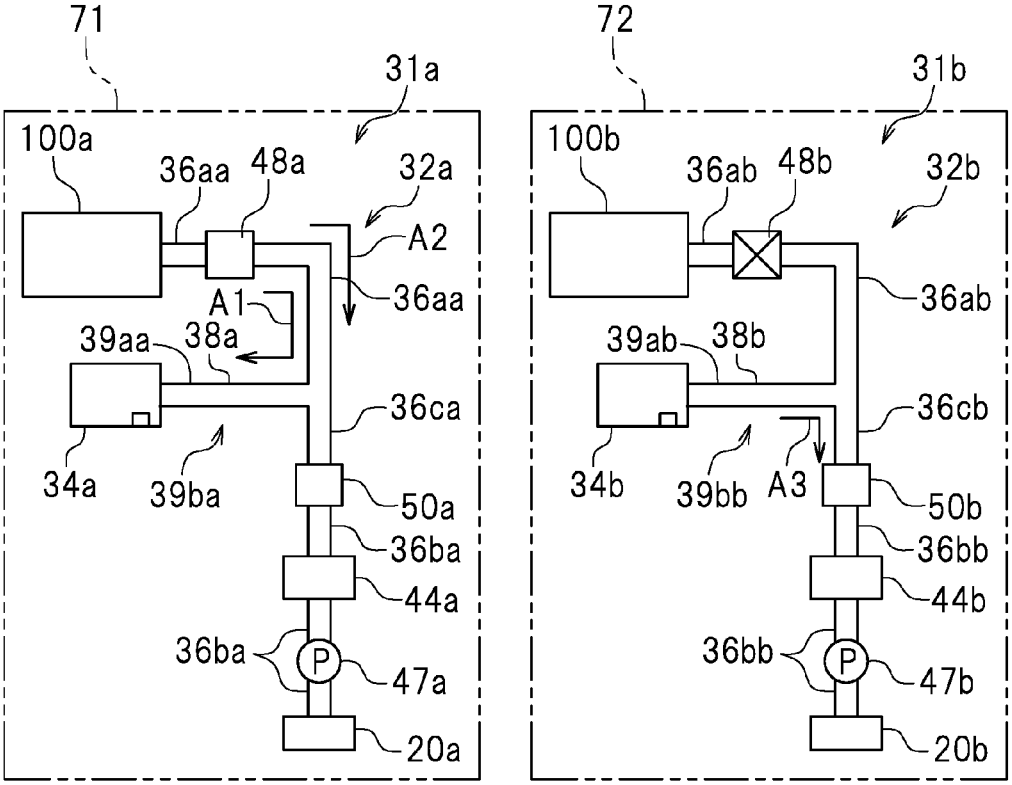
FIG. 5 is a schematic diagram showing a first ink supply mechanism and a second ink supply mechanism in a first standby state and a first printing state.
Figure 6:
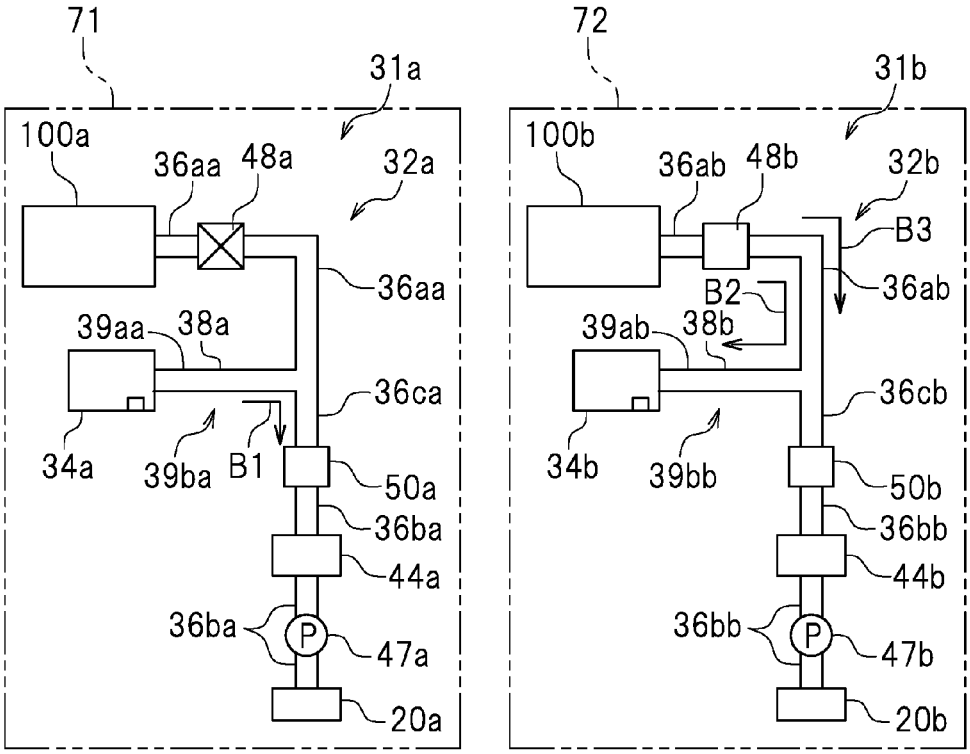
FIG. 6 is a schematic diagram showing the first ink supply mechanism and the second ink supply mechanism in a second standby state and a second printing state.

FIG. 5 is a schematic diagram showing a first ink supply mechanism 31*a* and a second ink supply mechanism 31*b* in a first standby state and a first printing state. FIG. 6 is a schematic diagram showing the first ink supply mechanism 31*a* and the second ink supply mechanism 31*b* in a second standby state and a second printing state. Note that in FIG. 5 and FIG. 6, arrows A1 to A3 and arrows B1 to B3 show the flow of ink. For each of valves 48*a*, 48*b*, 50*a* and 50*b* in FIG. 5 and FIG. 6, "x" indicates that the valve is closed. In the description below, as shown in FIG. 5, the ink supply mechanism 31 of the first group 71 will be referred to as the first ink supply mechanism 31*a*. The ink head 20, the ink cartridge 100, the sub-tank 34, the main supply channel 32, the upstream-side valve 48, the sub-supply channel 38, the downstream-side valve 50, the damper 44 and the supply pump 47 of the first ink supply mechanism 31*a* will be referred to as a first ink head 20*a*, a first ink cartridge 100*a*, a first sub-tank 34*a*, a first main supply channel 32*a*, a first upstream-side valve 48*a*, a first sub-supply channel 38*a*, a first downstream-side valve 50*a*, a first damper 44*a* and a first supply pump 47*a*, respectively. The main upstream portion 36*a*, the main downstream portion 36*b* and the middle portion 36*c* of the first main supply channel 32*a* will be referred to as a first main upstream portion 36*aa*, a first main downstream portion 36*ba* and a first middle portion 36*ca*, respectively. The sub-upstream portion 39*a* and the sub-downstream portion 39*b* of the first sub-supply channel 38*a* will be referred to as a first sub-upstream portion 39*aa* and a first sub-downstream portion 39*ba*, respectively. In the present preferred embodiment, the first ink cartridge 100*a* is an example of the "first main ink tank". The first sub-tank 34*a* is an example of the "first sub-ink tank".

The ink supply mechanism 31 of the second group 72 will be referred to as the second ink supply mechanism 31*b*. The ink head 20, the ink cartridge 100, the sub-tank 34, the main supply channel 32, the upstream-side valve 48, the sub-supply channel 38, the downstream-side valve 50, the damper 44 and the supply pump 47 of the second ink supply mechanism 31*b* will be referred to as a second ink head 20*b*, a second ink cartridge 100*b*, a second sub-tank 34*b*, a second main supply channel 32*b*, a second upstream-side valve 48*b*, a second sub-supply channel 38*b*, a second downstream-side valve 50*b*, a second damper 44*b* and a second supply pump 47*b*, respectively. The main upstream portion 36*a*, the main downstream portion 36*b* and the middle portion 36*c* of the second main supply channel 32*b* will be referred to as a second main upstream portion 36*ab*, a second main downstream portion 36*bb* and a second middle portion 36*cb*, respectively. The sub-upstream portion 39*a* and the sub-downstream portion 39*b* of the second sub-supply channel 38*b* will be referred to as a second sub-upstream. portion 39*ab* and a second sub-downstream portion 39b*b*, respectively. In the present preferred embodiment, the second ink cartridge 100*b* is an example of the "second main ink tank". The second sub-tank 34*b* is an example of the "second sub-ink tank".

In the present preferred embodiment, the open/closed states of the valves of the ink supply system 30 include the first standby state, the second standby state, the first printing state and the second printing state, as shown in FIG. 5 and FIG. 6. The first standby state and the second standby state are each an open/closed state of the valves during standby. The first printing state and the second printing state are each an open/closed state of the valves when printing. In the present preferred embodiment, as shown in FIG. 5, the open/closed state of the valves in the first standby state is the same as that in the first printing state. As shown in FIG. 6, the open/closed state of the valves in the second standby state is the same as that in the second printing state.

As shown in FIG. 5, in the first ink supply mechanism 31*a* of the first group 71 in the first standby state and the first printing state, the first upstream-side valve 48*a* and the first downstream-side valve 50*a* are open. That is, in the first ink supply mechanism 31*a* in the first standby state and the first printing state, the first main upstream portion 36*aa* and the first main downstream portion 36*ba* of the first main supply channel 32*a* are open. In the second ink supply mechanism 31*b* in the first standby state and the first printing state, the second upstream-side valve 48*b* is closed and the second downstream-side valve 50*b* is open.

Therefore, in the first ink supply mechanism 31*a* in the first standby state and the first printing state, ink stored in the first ink cartridge 100*a* flows as indicated by arrows Al and A2 to be supplied to the first ink head 20*a* and the first sub-tank 34*a*. Specifically, ink stored in the first ink cartridge 100*a* is supplied to the first ink head 20*a* via the first main upstream portion 36*aa*, the first middle portion 36*ca* and the first main downstream portion 36*ba* of the first main supply channel 32*a*, as indicated by arrow A2. At the same time, ink stored in the first ink cartridge 100*a* is supplied to the first sub-tank 34*a* via the first main upstream portion 36*aa* and the first sub-downstream portion 39*ba* and the first sub-upstream portion 39*aa* of the first sub-supply channel 38*a*, as indicated by arrow A1.

On the other hand, in the second ink supply mechanism 31*b* in the first standby state and the first printing state, the second main upstream portion 36*ab* of the second main supply channel 32*b* is closed and the second main downstream portion 36*bb* is open. Therefore, in the second ink supply mechanism 31*b* in the first standby state and the first printing state, since the second main upstream portion 36*ab* is closed, ink stored in the second ink cartridge 100*b* is not supplied to the second ink head 20*b* and the second sub-tank 34*b*. Herein, ink stored in the second sub-tank 34*b* is supplied to the second ink head 20*b*. Specifically, in the second ink supply mechanism 31*b* in the first standby state and the first printing state, ink stored in the second sub-tank 34*b* is supplied to the second ink head 20*b* via the second sub-upstream portion 39*ab* and the second sub-downstream portion 39*bb* of the second sub-supply channel 38*b* and the second middle portion 36*cb* and the second main downstream portion 36*bb* of the second main supply channel 32*b*, as indicated by arrow A3.

As shown in FIG. 5 and FIG. 6, the second standby state and the second printing state are states that are achieved by switching around the open/closed state of the valves in the first ink supply mechanism 31*a* in the first standby state and the first printing state and that in the second ink supply mechanism 31*b*. That is, in the second standby state and the second printing state, the open/closed state of the valves of the first ink supply mechanism 31*a* is the same as that of the valves of the second ink supply mechanism 31*b* in the first standby state and the first printing state. Specifically, in the first ink supply mechanism 31*a* in the second standby state and the second printing state, the first upstream-side valve 48*a* is closed and the first downstream-side valve 50*a* is open. In the first ink supply mechanism 31*a* in the second standby state and the second printing state, ink flows as indicated by arrow B1.

The open/closed state of the valves of the second ink supply mechanism 31*b* in the second standby state and the second printing state is the same as that of the valves of the first ink supply mechanism 31*a* in the first standby state and the first printing state. Specifically, in the second ink supply mechanism 31*b* in the second standby state and the second printing state, the second upstream-side valve 48*b* and the second downstream-side valve 50*b* are open. Therefore, in the second ink supply mechanism 31*b* in the second standby state and the second printing state, ink flows as indicated by arrows B2 and B3.

Figure 7:
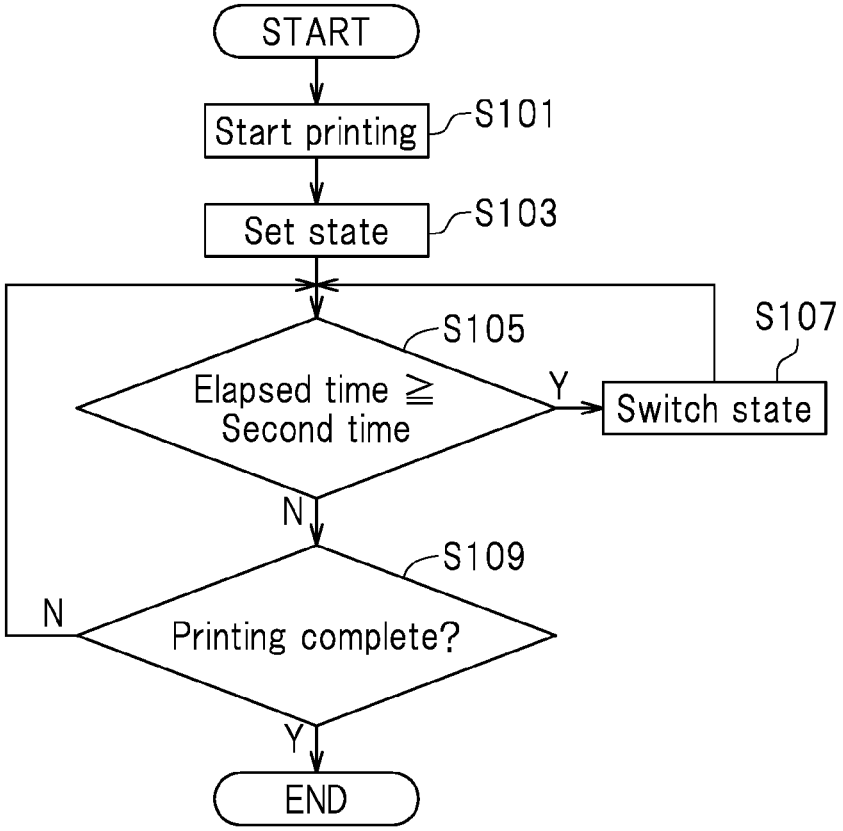
FIG. 7 is a flow chart showing a control procedure by the ink supply system when printing.

FIG. 7 is a flow chart showing a control procedure by the ink supply system 30 when printing. Next, transitions of the open/closed state of the valves of the ink supply mechanism 31 when printing will be described with reference to the flow chart of FIG. 7. When printing, the open/closed state of the valves in the first ink supply mechanism 31*a* included in the first group 71 is different from that in the second ink supply mechanism 31*b* included in the second group 72, and they are switched around after every passage of a predetermined amount of time (herein, the second amount of time).

First, in step S101, a printing operation by the printer 10 is started. At this point, the ink head 20 moves in the main scanning direction X along the guide rail 18. Then, when the ink head 20 is positioned above the recording medium 5 placed on the platen 14, ink is discharged onto the recording medium 5 to perform printing. Note that when printing, the supply pump 47 is operative.

As described above, after a printing operation is started, in step S103, a setting operation is performed to open and close the valves by the ink supply system 30. Herein, as shown in FIG. 5, the first printing setting processor 64 of the controller 28 sets the open/closed state of the valves to the first printing state. Thus, in the first ink supply mechanism 31*a*, ink to be discharged from the first ink head 20*a* is supplied from the first ink cartridge 100*a* as indicated by arrow A2. On the other hand, in the second ink supply mechanism 31*b*, the second upstream-side valve 48*b* is closed.

Therefore, ink to be discharged from the second ink head 20*b* is supplied from the second sub-tank 34*b* as indicated by arrow A3.

Note however that in step S103, the second printing setting processor 65 may set the open/closed state of the valves to the second printing state as shown in FIG. 6. In this case, in the first ink supply mechanism 31*a*, the first upstream-side valve 48*a* is closed. Therefore, ink to be discharged from the first ink head 20*a* is supplied from the first sub-tank 34*a* as indicted by arrow B1. On the other hand, in the second ink supply mechanism 3 l*b*, the second upstream-side valve 48*b* and the second downstream-side valve 50*b* are open. Therefore, ink to be discharged from the second ink head 20*b* is supplied from the second ink cartridge 100*b* as indicated by arrow B3.

Next, in step S105 of FIG. 7, the printing state determination processor 67 calculates the amount of time elapsed from when the open/closed state of the valves was set to the first printing state or the second printing state. Then, the printing state determination processor 67 determines whether or not the elapsed time is greater than or equal to the second amount of time. Note that the second amount of time is a value pre-stored in the storage processor 61. There is no particular limitation on the second amount of time. For example, the second amount of time is preferably such an amount of time that the first sub-tank 34*a* and the second sub-tank 34*b* will not be exhausted. The second amount of time preferably is about 1 to about 10 minutes, for example. The second amount of time preferably is about 5 minutes, for example.

In step S105, if it is determined by the printing state determination processor 67 that the amount of time elapsed from when the open/closed state of the valves was set to the first printing state or the second printing state is greater than or equal to the second amount of time, step S107 is performed next. In step S107, the printing state switching processor 69 switches the open/closed state of the valves. For example, as shown in FIG. 5, when the open/closed state of the valves is the first printing state, the printing state switching processor 69 switches the open/closed state of the valves from the first printing state to the second printing state as shown in FIG. 6. On the other hand, when the open/closed state of the valves is the second printing state, the printing state switching processor 69 switches the open/closed state of the valves from the second printing state to the first printing state as shown in FIG. 5. After the switching of the open/closed state of the valves in step S107, step S105 is performed again.

In step S105 of FIG. 7, if it is determined by the printing state determination processor 67 that the amount of time elapsed from when the open/closed state of the valves was set to the first printing state or the second printing state is less than the second amount of time, step S109 is performed next. Next, in step S109, it is determined if a printing operation has been completed. For example, it is determined if a printing operation has been completed based on whether or not the controller 28 has received a print-end signal from the printer 10. When the controller 28 receives a print-end signal and determines that a printing operation by the printer 10 has been completed, the printing process is ended. On the other hand, when the controller 28 determines that a printing operation by the printer 10 has not been completed, step S105 is again performed next. As described above, in the present preferred embodiment, the open/closed state of the valves in the ink supply system 30 is switched from the first printing state to the second printing state or from the second printing state to the first printing state after every passage of the second amount of time.

Figure 8:
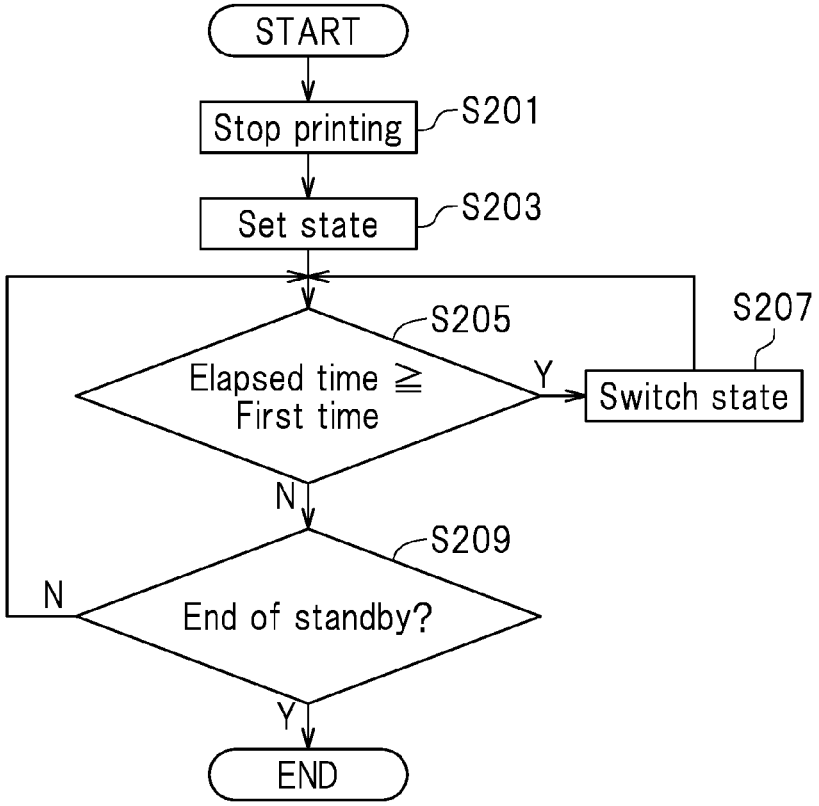
FIG. 8 is a flow chart showing a control procedure by the ink supply system during standby.

FIG. 8 is a flow chart showing a control procedure by the ink supply system 30 during standby. Next, transitions of the open/closed state of the valves of the ink supply mechanism. 31 during standby will be described with reference to the flow chart of FIG. 8. Herein, "during standby" refers to a period of time when the printer 10 is not printing. Also, "during standby" refers to a state where the ink head 20 is located at the home position. In the present preferred embodiment, the downstream-side valve 50 is open even during standby. Even during standby, as when printing, the open/closed state of the valves in the first ink supply mechanism 31*a* included in the first group 71 is different from that in the second ink supply mechanism 31*b* included in the second group 72, and they are switched around after every passage of a predetermined amount of time (herein, the first amount of time).

First, in step S201, the printer 10 which is printing stops printing. For example, a printing operation ends when the controller 28 receives a print-end signal. Then, the ink head 20 moves to the home position located at the right end of the guide rail 18. Then, at the home position, the cap 52 is attached to the ink head 20. Note that the supply pumps 47*a* and 47*b* are stopped during standby. Therefore, it is unlikely that ink leaks from the ink head 20 unless the suction pump 54 connected to the cap 52 is operative.

After a printing operation ends and the system is on standby, in step S203, a setting operation is performed for the open/closed state of the valves by the ink supply system 30. In step S203, the first standby setting processor 62 of the controller 28 sets the open/closed state of the valves in each ink supply mechanism 31 to the first standby state as shown in FIG. 5. In the first ink supply mechanism 31*a* in the first standby state, the first upstream-side valve 48*a* and the first downstream-side valve 50*a* are open. In the second ink supply mechanism 31*b* in the first standby state, the second upstream-side valve 48*b* is closed. The second downstream-side valve 50*b* is open. In the present preferred embodiment, the supply pumps 47*a* and 47*b* are stopped during standby, as described above. Therefore, even when the downstream-side valve 50 is not closed, ink in the main supply channel 32 and the sub-supply channel 38 is not discharged from the ink head 20 but the ink is slightly flowing through the main supply channel 32 and the sub-supply channel 38, unless the suction pump 54 is operative.

Note that instep S203, the second standby setting processor 63 may set the open/closed state of the valves to the second standby state as shown in FIG. 6. In the first ink supply mechanism 31*a* in the second standby state, the first upstream-side valve 48*a* is closed and the first downstream-side valve 50*a* is open. In the second ink supply mechanism 31*b* in the second standby state, the second upstream-side valve 48*b* and the second downstream-side valve 50*b* are open.

Next, in step S205 of FIG. 8, the standby state determination processor 66 calculates the amount of time elapsed from when the open/closed state of the valves was set to the first standby state or the second standby state. Then, the standby state determination processor 66 determines whether or not the elapsed time is greater than or equal to the first amount of time. Note that the first amount of time is a value pre-stored in the storage processor 61. In the present preferred embodiment, the first amount of time is longer than the second amount of time, which is used when printing. That is, the second amount of time is shorter than the first amount of time. There is no particular limitation on the specific value of the first amount of time. For example, the first amount of time is preferably such an amount of time that the operator will not feel stressed by the switching of the open/closed state of the valves during standby. The upper limit value of the first amount of time is preferably determined taking into consideration the temperature characteristics and the swelling characteristics of the ink. Thus, the first amount of time is preferably from about 20 minutes to about 60 minutes, for example. The first amount of time is preferably about 30 minutes, for example.

In step S205, if it is determined by the standby state determination processor 66 that the amount of time elapsed from when the open/closed state of the valves was set to the first standby state or the second standby state is greater than or equal to the first amount of time, step S207 is performed next. In step S207, the standby state switching processor 68 switches the open/closed state of the valves. For example, when the open/closed state of the valves is the first standby state, the standby state switching processor 68 switches the open/closed state of the valves from the first standby state to the second standby state as shown in FIG. 6. On the other hand, when the open/closed state of the valves is the second standby state, the standby state switching processor 68 switches the open/closed state of the valves from the second standby state to the first standby state as shown in FIG. 5. After the switching of the open/closed state of the valves in step S207, step S205 is performed again.

In step S205 of FIG. 8, if it is determined by the standby state determination processor 66 that the amount of time elapsed from when the open/closed state of the valves was set to the first standby state or the second standby state is less than the first amount of time, step S209 is performed next. Next, in step S209, it is determined whether or not to start a printing operation. For example, it is determined whether or not to start a printing operation based on whether or not the controller 28 has received a print-start signal. When the controller 28 receives a print-start signal, the standby process is ended. On the other hand, when the controller 28 determines that the system is on standby, step S205 is again performed next. As described above, in the present preferred embodiment, the open/closed state of the valves in the ink supply system 30 is switched from the first standby state to the second standby state or from the second standby state to the first standby state after every passage of the first amount of time, which is longer than the second amount of time, during standby.

As described above, in the present preferred embodiment, the open/closed state of the valves 48 and 50 is switched from the first standby state to the second standby state or from the second standby state to the first standby state by the standby state switching processor 68 after every passage of the first amount of time, as shown in FIG. 5 and FIG. 6, during standby. Therefore, during standby, since the first upstream-side valve 48*a* is open in the first standby state, the pressure in the main supply channel 32*a* is released toward the first ink cartridge 100*a*. Therefore, it is possible to prevent ink from swelling and leaking from the first ink head 20*a* during standby.

Note that in order to prevent ink from swelling during standby, one may consider leaving all of the upstream-side valve 48 and the downstream-side valve 50 open at all times. However, if all the valves 48 and 50 are left open at all times, ink may possibly leak from the ink head 20 because of the valves being open for a long time. In view of this, in the present preferred embodiment, the open/closed state of the upstream-side valve 48 is switched after every passage of an amount of time that is greater than or equal to the first amount of time during standby, thus shortening the state in which all the valves 48 and 50 are left open at all times. Therefore, it is possible to better prevent ink from leaking from the ink head 20.

If the main supply channel 32 and the sub-supply channel 38 were broken and all the valves 48 and 50 were left open at all times, more ink would leak from the broken portions. However, in the present preferred embodiment, the open/closed state of the upstream-side valve 48 is switched after every passage of an amount of time that is greater than or equal to the first amount of time during standby. Therefore, even if the main supply channel 32 and the sub-supply channel 38 are broken during standby, it is possible to reduce the amount of ink that leaks from the broken portions, as compared with a case in which the valves 48 and 50 are left open at all times.

According to the present preferred embodiment, the printing state determination processor 67 determines whether or not the amount of time elapsed from when the state was set to the first printing state or the second printing state by the first printing setting processor 64 or the second printing setting processor 65 is greater than or equal to the second amount of time, which is shorter than the first amount of time. Then, if it is determined by the printing state determination processor 67 that the elapsed time is greater than or equal to the second amount of time, the printing state switching processor 69 switches either from the first printing state to the second printing state or from the second printing state to the first printing state. Thus, the only difference between when printing and during standby is the time elapsed based on which the open/closed state of the valves is switched, and the control is otherwise the same between when printing and during standby. Therefore, it is possible to ensure an ink flow when printing and during standby without complicated control.

According to the present preferred embodiment, as shown in FIG. 2, a plurality of ink supply mechanisms 31 are divided into the first group 71 and the second group 72 so that the first ink supply mechanism 31*a* of the first group 71 and the second ink supply mechanism 31*b* of the second group 72 are controlled differently. In the first standby state and the first printing state, in the first ink supply mechanism 31*a*, the first upstream-side valve 48*a* and the first downstream-side valve 50*a* are open. In the first standby state and the first printing state, in the second ink supply mechanism 31*b*, the second upstream-side valve 48*b* is closed and the second downstream-side valve 50*b* is open. In the second standby state and the second printing state, in the first ink supply mechanism 31*a*, the first upstream-side valve 48*a* is closed and the first downstream-side valve 50*a* is open. In the second standby state and the second printing state, in the second ink supply mechanism 31*b*, the second upstream-side valve 48*b* and the second downstream-side valve 50*b* are open. Thus, in the first printing state and the second printing state, the second downstream-side valve 50*b* is open. Therefore, when printing, whether in the first printing state or in the second printing state, ink stored in the ink cartridge 100 or the sub-tank 34 is supplied to the ink head 20. Therefore, when printing, the open/closed state of the valves can be switched without stopping the printing operation.

In the present preferred embodiment, immediately after the switching of the open/closed state of the upstream-side valve 48, ink pulsation is caused by the propagation of pressure waves in the main supply channel 32 and the sub-supply channel 38. For example, the phase of the pulsation immediately after the upstream-side valve 48 is switched from the closed state to the open state is opposite to the phase of the pulsation immediately after the upstream-side valve 48 is switched from the open state to the closed state. If the upstream-side valve 48 were switched from closed to open or the upstream-side valve 48 were switched from open to closed in all of the first ink supply mechanisms 31*a* of the first group 71 and the second ink supply mechanisms 31*b* of the second group 72, all of the ink supply mechanisms 31 would be in the same pulsation phase. Then, the pulsations would be superposed together to produce a significant vibration, affecting the printer 10. However, in the present preferred embodiment, in the first ink supply mechanism 31*a* and the second ink supply mechanism 31*b*, when the first upstream-side valve 48*a* is switched from open to closed, the second upstream-side valve 48*b* is switched from closed to open. On the other hand, when the first upstream-side valve 48*a* is switched from closed to open, the second upstream-side valve 48*b* is switched from open to closed. Therefore, immediately after the switching of the open/closed state of the upstream-side valve 48, the phase of the pulsation in the first ink supply mechanism 31*a* is opposite to the phase of the pulsation in the second ink supply mechanism 31*b*. Therefore, even immediately after the switching of the open/closed state of the upstream-side valve 48, pulsations are canceled out with each other, thus controlling vibration caused by pulsation.

According to the present preferred embodiment, the amount of ink that is able to be stored in the first ink cartridge 100*a* and the second ink cartridge 100*b* is the first amount. The amount of ink that is able to be stored in the first sub-tank 34*a* and the second sub-tank 34*b* is the second amount, which is smaller than the first amount. Therefore, when the first sub-tank 34*a* and the second sub-tank 34*b* are exhausted, for example, they are able to be replenished with ink in the first ink cartridge 100*a* and ink in the second ink cartridge 100*b*, respectively. Thus, it is possible to increase the amount of ink available as compared with printers in which the ink cartridge 100 is connected to the ink head 20 and no sub-tank 34 is connected to the ink head 20.

According to the present preferred embodiment, the ink supply system 30 includes the first supply pump 47*a* provided on the first main downstream portion 36*ba* in the first ink supply mechanism 31*a* to discharge ink from the nozzle 21 of the first ink head 20*a*, and the second supply pump 47*b* provided on the second main downstream portion 36*bb* in the second ink supply mechanism 31*b* to discharge ink from the nozzle 21 of the second ink head 20*b*. During standby, the first supply pump 47*a* and the second supply pump 47*b* are stopped by the first standby setting processor 62 and the second standby setting processor 63. Thus, even when the first downstream-side valve 50*a* and the second downstream-side valve 50*b* are opened during standby, it is possible to prevent ink from leaking from the first ink head 20*a* and the second ink head 20*b* because the first supply pump 47*a* and the second supply pump 47*b* are stopped.

The printer 10 including the ink supply system 30 according to the first preferred embodiment has been described above. The printer of the present invention is not limited to the printer 10 of the first preferred embodiment, but can be implemented in various other preferred embodiments. Next, another preferred embodiment of the present invention will be described briefly. Note that in the description below, like elements to those that have already been described above will be denoted by like reference signs and will not be further described below.

Second Preferred Embodiment

In the first preferred embodiment, the first standby state preferably is the same as the first printing state, and the second standby state is the second printing state. Specifically, as shown in FIG. 5, in the first ink supply mechanism 31*a* in the first standby state, the first upstream-side valve 48*a* and the first downstream-side valve 50*a* are open. In the second ink supply mechanism 31*b* in the first standby state, the second upstream-side valve 48*b* is closed and the second downstream-side valve 50*b* is open. As shown in FIG. 6, in the first ink supply mechanism 31*a* in the second standby state, the first upstream-side valve 48*a* is closed and the first downstream-side valve 50*a* is open. In the second ink supply mechanism 31*b* in the second standby state, the second upstream-side valve 48*b* and the second downstream-side valve 50*b* are open. However, the first standby state may be different from the first printing state. The second standby state may be different from the second printing state.

Figure 9:
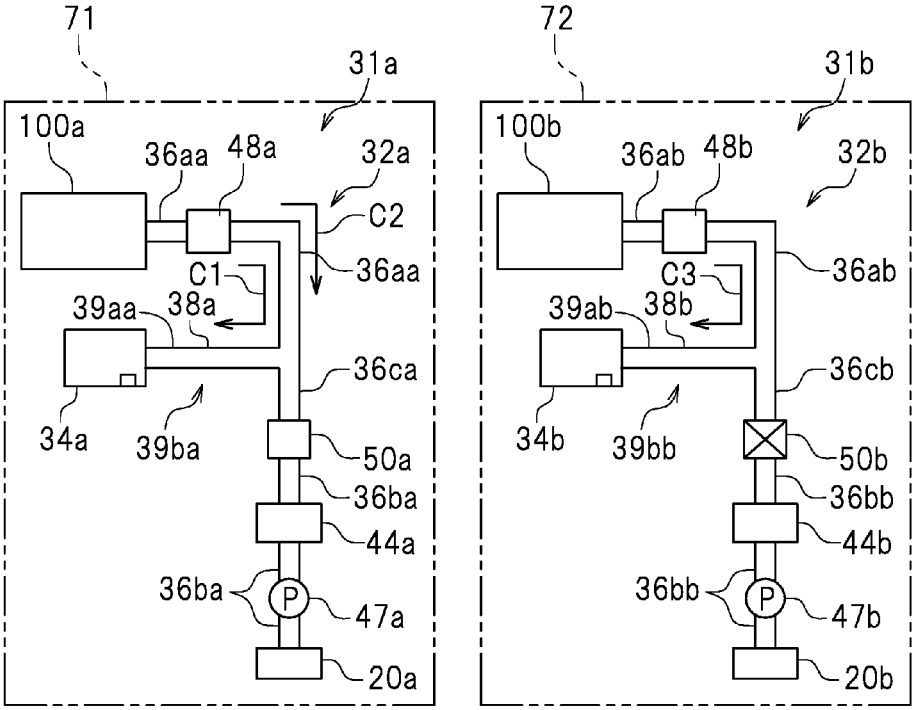
FIG. 9 is a schematic diagram showing the first ink supply mechanism and the second ink supply mechanism in the first standby state according to a second preferred embodiment of the present invention.
Figure 10:
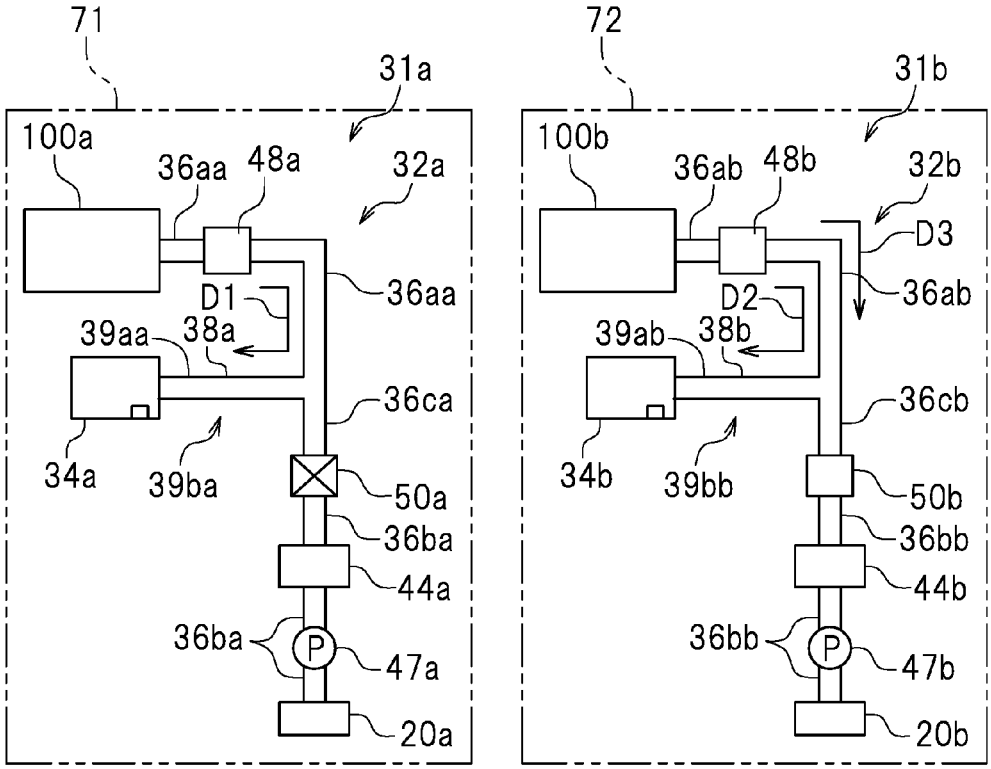
FIG. 10 is a schematic diagram showing the first ink supply mechanism and the second ink supply mechanism in the second standby state according to the second preferred embodiment of the present invention.

Next, a printer according to the second preferred embodiment of the present invention will be described. FIG. 9 is a schematic diagram showing the first ink supply mechanism 31*a* and the second ink supply mechanism 31*b* in the first standby state according to the second preferred embodiment. FIG. 10 is a schematic diagram showing the first ink supply mechanism 31*a* and the second ink supply mechanism 31*b* in the second standby state according to the second preferred embodiment. Note that in FIG. 9 and FIG. 10, arrows C1 to C3 and arrows D1 to D3 show the flow of ink. For each of valves 48*a*, 48*b*, 50*a* and 50*b* in FIG. 9 and FIG. 10, "x" indicates that the valve is closed. In the second preferred embodiment, as shown in FIG. 9, in the first ink supply mechanism 31*a* in the first standby state, the first upstream-side valve 48*a* and the first downstream-side valve 50*a* are open, as in the first preferred embodiment. In the second ink supply mechanism 31*b* in the first standby state, the second upstream-side valve 48*b* is open and the second downstream-side valve 50*b* is closed. Then, in the second preferred embodiment, as shown in FIG. 10, in the first ink supply mechanism 31*a* in the second standby state, the first upstream-side valve 48*a* is open and the first downstream-side valve 50*a* is closed. In the second ink supply mechanism 31*b* in the second standby state, the second upstream-side valve 48*b* and the second downstream-side valve 50*b* are open, as in the first preferred embodiment. In the present preferred embodiment, between the first standby state and the second standby state, the open/closed state of the first downstream-side valve 50*a* of the first ink supply mechanism. 31*a* and that of the second downstream-side valve 50*b* of the second ink supply mechanism 31*b* are switched around.

Note that in the present preferred embodiment, the first printing state and the second printing state preferably are the same as the first printing state and the second printing state of the first preferred embodiment. Transitions of the open/closed state of the valves of the ink supply mechanism 31 when printing preferably are the same as those when printing in the first preferred embodiment. Therefore, the first printing state, the second printing state, and the transitions of the open/closed state of the valves of the ink supply mechanism 31 when printing according to the present preferred embodiment will not be described below.

Next, transitions of the open/closed state of the valves of the ink supply mechanism 31 during standby according to the present preferred embodiment will be described. In the present preferred embodiment, since the control procedure by the ink supply system 30 during standby is the same as that of the flow chart of FIG. 8, transitions of the open/closed state of the valves of the ink supply mechanism 31 during standby will be described using the flow chart of FIG. 8.

First, in step S201, the printer 10 which is printing stops printing. During standby, the first supply pump 47*a* and the second supply pump 47*b* are stopped. Then, in step S203, the first standby setting processor 62 of the controller 28 sets the open/closed state of the valves in the ink supply mechanism 31 to the first standby state as shown in FIG. 9. Specifically, in the first printing state, the first upstream-side valve 48*a* and the first downstream-side valve 50*a* are open. In the second ink supply mechanism 31*b* in the first standby state, the second upstream-side valve 48*b* is open and the second downstream-side valve 50*b* is closed. Therefore, in the first standby state, ink stored in the first ink cartridge 100*a* flows through the first main supply channel 32*a* and the first sub-supply channel 38*a* as indicated by arrows C1 and C2. Ink stored in the second ink cartridge 100*b* is supplied to the second sub-tank 34*b* through the second main upstream portion 36ab of the second main supply channel 32*b* and the second sub-supply channel 38*b* as indicated by arrow C3.

Note that in step S203 of FIG. 8, the second standby setting processor 63 may set the open/closed state of the valves to the second standby state as shown in FIG. 10. Then, in the first ink supply mechanism 31*a* in the second standby state, the first upstream-side valve 48*a* is open and the first downstream-side valve 50*a* is closed. Then, ink flows as indicated by arrow D1. In the second ink supply mechanism 31*b* in the second standby state, the second upstream-side valve 48*b* and the second downstream-side valve 50*b* are open. Then, ink flows as indicated by arrows D2 and D3.

Next, in step S205 of FIG. 8, the standby state determination processor 66 calculates the amount of time elapsed from when the open/closed state of the valves was set to the first standby state or the second standby state. Then, the standby state determination processor 66 determines whether or not the elapsed time is greater than or equal to the first amount of time, which is longer than the second amount of time. If it is determined by the standby state determination processor 66 that the amount of time elapsed from when the open/closed state of the valves was set to the first standby state or the second standby state is greater than or equal to the first amount of time, step S207 is performed next. In step S207, the standby state switching processor 68 switches the open/closed state of the valves. For example, when the open/closed state of the valves is the first standby state, the standby state switching processor 68 switches the open/closed state of the valves from the first standby state to the second standby state as shown in FIG. 10. On the other hand, when the open/closed state of the valves is the second standby state, the standby state switching processor 68 switches the open/closed state of the valves from the second standby state to the first standby state as shown in FIG. 9. After the switching of the open/closed state of the valves in step S207, step S205 is performed again.

In step S205 of FIG. 8, if it is determined by the standby state determination processor 66 that the amount of time elapsed from when the open/closed state of the valves was set to the first standby state or the second standby state is less than the first amount of time, step S209 is performed next. Next, in step S209, it is determined whether or not to start a printing operation. For example, when the controller 28 receives a print-start signal, the standby process is ended. On the other hand, when the controller 28 determines that the system is on standby, step S205 is again performed next.

As described above, in the present preferred embodiment, during standby, the standby state switching processor 68 switches the open/closed state of the valves 48 and 50 from the first standby state to the second standby state or from the second standby state to the first standby state after every passage of the first amount of time. Therefore, during standby, since the first downstream-side valve 50*a* is open in the first standby state, the pressure in the main supply channel 32 is released toward the first ink cartridge 100*a*. Therefore, it is possible to prevent ink from swelling and leaking from the first ink head 20*a* during standby. The present preferred embodiment achieves similar advantageous effects to those of the first preferred embodiment.

Note that the various processors of the controller 28, i.e., the storage processor 61, the first standby setting processor 62, the second standby setting processor 63, the first printing setting processor 64, the second printing setting processor 65, the standby state determination processor 66, the printing state determination processor 67, the standby state switching processor 68 and the printing state switching processor 69, maybe implemented by software.

That is, the various processors may be implemented by a computer with a computer program loaded on the computer. The present invention encompasses a non-transitory computer readable medium including a computer program that instructs a computer to function as the various processors described above. The various processors may be implemented by a processor or processors executing a computer program stored in the controller 28. In this case, the various processors may be implemented by a single processor or may be implemented by a plurality of processors. The present invention also encompasses a circuit that implements similar functions to those realized by programs executed by the various processors.

The terms and expressions used herein are used for explanation purposes and should not be construed as being restrictive. It should be appreciated that the terms and expressions used herein do not eliminate any equivalents of features illustrated and mentioned herein, but include various modifications falling within the claimed scope of the present invention. The present invention may be embodied in many different forms and preferred embodiments. The present disclosure is to be considered as providing non-limiting examples of the principles of the present invention. These non-limiting examples are described herein with the understanding that such examples are not intended to limit the present invention to preferred embodiments described herein and/or illustrated herein. Hence, the present invention is not limited to the preferred embodiments described herein. The present invention includes any and all preferred embodiments including equivalent elements, modifications, omissions, combinations, adaptations and/or alterations as would be appreciated by those skilled in the art on the basis of the present disclosure. The limitations in the claims are to be interpreted broadly based on the language included in the claims and not limited to examples described in the present specification or during the prosecution of the application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ink supply system comprising:

a first ink head including a first nozzle that discharges ink;

a first main ink tank that stores ink;

a first sub-ink tank that stores ink;

a first main supply channel, including a first main upstream portion connected to the first main ink tank, a first main downstream portion connected to the first ink head, and a first middle portion located between the first main upstream portion and the first main downstream portion;

a first sub-supply channel, including a first sub-upstream portion connected to the first sub-ink tank and a first sub-downstream portion connected to the first middle portion of the first main supply channel;

a first upstream-side valve provided on the first main upstream portion of the first main supply channel, the first upstream-side valve being able to be opened and closed; and a controller configured or programmed to control an open/closed state of the first upstream-side valve, the controller being configured or programmed to include:

a first standby setting processor that sets a first standby state in which the first upstream-side valve is open during standby;

a second standby setting processor that sets a second standby state in which the first upstream-side valve is closed during standby;

a standby state determination processor that determines whether or not an amount of time elapsed from when a setting operation was done by the first standby setting processor or the second standby setting processor is greater than or equal to a first amount of time; and a standby state switching processor that either switches from the first standby state to the second standby state or switches from the second standby state to the first standby state when it is determined by the standby state determination processor that an elapsed time is greater than or equal to the first amount of time.

2. An ink supply system according to claim 1, further comprising:

a first downstream-side valve provided between the first middle portion and the first main downstream portion of the first main supply channel, the first downstream-side valve being able to be opened and closed, wherein the first standby state and the second standby state are each a state in which the first downstream-side valve is open;

the controller controls an open/closed state of the first downstream-side valve; and the controller is configured or programmed to include:

a first printing setting processor that sets a first printing state in which the first upstream-side valve and the first downstream-side valve are open when printing;

a second printing setting processor that sets a second printing state in which the first upstream-side valve is closed and the first downstream-side valve is open when printing;

a printing state determination processor that determines whether or not an amount of time elapsed from when a setting operation was done by the first printing setting processor or the second printing setting processor is greater than or equal to a second amount of time, which is shorter than the first amount of time; and a printing state switching processor that either switches from the first printing state to the second printing state or switches from the second printing state to the first printing state when it is determined by the printing state determination processor that an elapsed time is greater than or equal to the second amount of time.

3. An ink supply system according to claim 2, further comprising:

a second ink head including a second nozzle that discharges ink;

a second main ink tank that stores ink;

a second sub-ink tank that stores ink;

a second main supply channel, including a second main upstream portion connected to the second main ink tank, a second main downstream portion connected to the second ink head, and a second middle portion located between the second main upstream portion and the second main downstream portion;

a second sub-supply channel, including a second sub-upstream portion connected to the second sub-ink tank and a second sub-downstream portion connected to the second middle portion of the second main supply channel;

a second upstream-side valve provided on the second main upstream portion of the second main supply channel, the second upstream-side valve being able to be opened and closed; and a second downstream-side valve located between the second middle portion and the second main downstream portion of the second main supply channel, the second downstream-side valve being able to be opened and closed; wherein the controller controls an open/closed state of the second upstream-side valve and an open/closed state of the second downstream-side valve;

the first standby state and the first printing state are each a state in which the second upstream-side valve is closed and the second downstream-side valve is open; and the second standby state and the second printing state are each a state in which the second upstream-side valve and the second downstream-side valve are open.

4. An ink supply system according to claim 3, wherein:

an amount of ink that is able to be stored in the first main ink tank and the second main ink tank is a first amount; and an amount of ink that is able to be stored in the first sub-ink tank and the second sub-ink tank is a second amount, which is smaller than the first amount.

5. An ink supply system according to claim 1, further comprising:

a first supply pump is provided on the first main downstream portion and that discharges ink from the first nozzle of the first ink head; wherein the first standby setting processor and the second standby setting processor stop the first supply pump.

6. An inkjet printer comprising:

a platen on which a recording medium is placed; and the ink supply system according to claim 1.

7. An ink supply system comprising:

a first ink head including a first nozzle that discharges ink;

a first main ink tank that stores ink;

a first sub-ink tank that stores ink;

a first main supply channel, including a first main upstream portion connected to the first main ink tank, a first main downstream portion connected to the first ink head, and a first middle portion located between the first main upstream portion and the first main downstream portion;

a first sub-supply channel, including a first sub-upstream portion connected to the first sub-ink tank and a first sub-downstream portion connected to the first middle portion of the first main supply channel;

a first downstream-side valve provided between the first middle portion and the first main downstream portion of the first main supply channel, the first downstream-side valve being able to be opened and closed; and a controller configured or programmed to control an open/closed state of the first downstream-side valve; wherein the controller is configured or programmed to include:

a first standby setting processor that sets a first standby state in which the first downstream-side valve is open;

a second standby setting processor that sets a second standby state in which the first downstream-side valve is closed;

a standby state determination processor that determines whether or not an amount of time elapsed from when a setting operation was done by the first standby setting processor or the second standby setting processor is greater than or equal to a first amount of time; and a standby state switching processor that either switches from the first standby state to the second standby state or switches from the second standby state to the first standby state when it is determined by the standby state determination processor that an elapsed time is greater than or equal to the first amount of time, during standby.

8. An ink supply system according to claim 7, further comprising:

a first upstream-side valve provided on the first main upstream portion of the first main supply channel, the first upstream-side valve being able to be opened and closed; wherein the first standby state and the second standby state are each a state in which the first upstream-side valve is open;

the controller controls an open/closed state of the first upstream-side valve; and the controller is configured or programmed to include:

a first printing setting processor that sets a first printing state in which the first upstream-side valve and the first downstream-side valve are open when printing;

a second printing setting processor that sets a second printing state in which the first upstream-side valve is closed and the first downstream-side valve is open when printing;

a printing state determination processor that determines whether or not an amount of time elapsed from when a setting operation was done by the first printing setting processor or the second printing setting processor is greater than or equal to a second amount of time, which is shorter than the first amount of time; and a printing state switching processor that either switches from the first printing state to the second printing state or switches from the second printing state to the first printing state when it is determined by the printing state determination processor that an elapsed time is greater than or equal to the second amount of time.

9. An ink supply system according to claim 8, further comprising:

a second ink head including a second nozzle that discharges ink;

a second main ink tank that stores ink;

a second sub-ink tank that stores ink;

a second main supply channel, including a second main upstream portion connected to the second main ink tank, a second main downstream portion connected to the second ink head, and a second middle portion located between the second main upstream portion and the second main downstream portion;

a second sub-supply channel, including a second sub-upstream portion connected to the second sub-ink tank and a second sub-downstream portion connected to the second middle portion of the second main supply channel;

a second upstream-side valve provided on the second main upstream portion of the second main supply channel, the second upstream-side valve being able to be opened and closed; and a second downstream-side valve provided between the second middle portion and the second main downstream portion of the second main supply channel, the second downstream-side valve being able to be opened and closed; wherein the controller controls an open/closed state of the second upstream-side valve and an open/closed state of the second downstream-side valve;

the first standby state is a state in which the second upstream-side valve is open and the second downstream-side valve is closed;

the second standby state and the second printing state are each a state in which the second upstream-side valve and the second downstream-side valve are open; and the first printing state is a state in which the second upstream-side valve is closed and the second downstream-side valve is open.

10. An ink supply system according to claim 9, wherein:

an amount of ink that is able to be stored in the first main ink tank and the second main ink tank is a first amount; and an amount of ink that is able to be stored in the first sub-ink tank and the second sub-ink tank is a second amount, which is smaller than the first amount.

11. An ink supply system according to claim 7, wherein:

a first supply pump is provided on the first main downstream portion and that discharges ink from the first nozzle of the first ink head; and the first standby setting processor and the second standby setting processor stop the first supply pump.

* * * * *